US011773666B2

(12) United States Patent
Giroux

(10) Patent No.: US 11,773,666 B2
(45) **Date of Patent: *Oct. 3, 2023**

(54) FLOAT VALVE INSERT

(71) Applicant: Weatherford Technology Holdings, LLC, Houston, TX (US)

(72) Inventor: Richard Lee Giroux, Belville, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/076,770

(22) Filed: Dec. 7, 2022

(65) Prior Publication Data

US 2023/0101467 A1 Mar. 30, 2023

Related U.S. Application Data

(63) Continuation of application No. 16/951,562, filed on Nov. 18, 2020, now Pat. No. 11,542,781.

(51) Int. Cl.
*E21B 21/10* (2006.01)
*E21B 34/08* (2006.01)
(Continued)

(52) U.S. Cl.
CPC ..... *E21B 21/10* (2013.01); *E21B 34/063* (2013.01); *E21B 34/08* (2013.01); *E21B 34/14* (2013.01); *E21B 43/10* (2013.01); *E21B 2200/05* (2020.05)

(58) Field of Classification Search
CPC ..... E21B 34/08; E21B 34/14; E21B 34/142; E21B 33/14; E21B 33/13; E21B 21/00; E21B 21/10–106; E21B 2200/05
See application file for complete search history.

(56) References Cited

U.S. PATENT DOCUMENTS 1,937,188 A * 11/1933 Bloss ..... E21B 21/10 166/328
3,376,935 A * 4/1968 Baker ..... E21B 21/10 166/325

(Continued)

FOREIGN PATENT DOCUMENTS

AU 2015252010 B2 12/2015
EP 1443175 A1 8/2004
WO 2018169694 A1 9/2018

OTHER PUBLICATIONS

Davis Lynch, Equipment Catalog No. 20, pp. 1-29, undated.

(Continued)

*Primary Examiner* — George S Gray
(74) *Attorney, Agent, or Firm* — Cabello Hall Zinda, PLLC

(57) ABSTRACT

A float valve is used in a tubular having a through-bore for flow. The tubular can be a casing joint, a casing pup joint, a housing or a shell of a float collar/shoe, or other tubular element. A sleeve of drillable material is expanded inside the tubular. Sealing and/or anchor elements on the exterior of the sleeve can engage inside the tubular. Caps composed of drillable material are disposed on ends of the sleeve and have passages connected to ends of a flow tube. The flow tub is also composed of drillable material and has a bore therethrough for flow. A valve composed of drillable material is disposed in the passage of one of the caps and is configured to control the flow in the tubing through the flow tube.

20 Claims, 15 Drawing Sheets

(51) Int. Cl.

| | |
|---|---|
| ***E21B 34/04*** | (2006.01) |
| ***E21B 34/06*** | (2006.01) |
| ***E21B 43/10*** | (2006.01) |
| ***E21B 34/14*** | (2006.01) |

(56) References Cited

U.S. PATENT DOCUMENTS

| | | | | |
|---|---|---|---|---|
| 4,250,966 | A * | 2/1981 | Streich | E21B 17/14 166/285 |
| 4,378,818 | A | 4/1983 | Cormier, Jr. | |
| 4,589,495 | A | 5/1986 | Anger et al. | |
| 5,025,858 | A | 6/1991 | Glaser | |
| 5,058,672 | A | 10/1991 | Cochran | |
| 5,450,903 | A | 9/1995 | Budde | |
| 6,497,291 | B1 | 12/2002 | Szarka | |
| 6,739,392 | B2 | 5/2004 | Cook et al. | |
| 7,287,584 | B2 | 10/2007 | Angman | |
| 7,383,889 | B2 | 6/2008 | Ring et al. | |
| 7,434,618 | B2 | 10/2008 | Cook et al. | |
| 7,484,559 | B2 | 2/2009 | Vert et al. | |
| 7,775,290 | B2 | 8/2010 | Brisco et al. | |
| D679,336 | S | 4/2013 | White | |
| 8,522,885 | B2 | 9/2013 | Giroux et al. | |
| 9,637,977 | B2 | 5/2017 | Giroux et al. | |
| 9,850,726 | B2 | 12/2017 | Gandikota et al. | |
| 2003/0116320 | A1 * | 6/2003 | Szarka | E21B 34/103 166/291 |
| 2005/0023000 | A1 | 2/2005 | Warren et al. | |
| 2007/0114031 | A1 | 5/2007 | Hebert et al. | |
| 2009/0065196 | A1 | 3/2009 | Holland et al. | |
| 2009/0151930 | A1 | 6/2009 | Giroux | |
| 2014/0216742 | A1 * | 8/2014 | Darbe | E21B 33/14 166/285 |
| 2016/0273288 | A1 | 9/2016 | Lajesic et al. | |
| 2017/0292338 | A1 | 10/2017 | Downey et al. | |
| 2017/0370186 | A1 | 12/2017 | Stair | |
| 2020/0109609 | A1 | 4/2020 | Hawkins, III | |
| 2020/0191270 | A1 | 6/2020 | Diaz | |
| 2021/0062611 | A1 | 3/2021 | Yeldell et al. | |

OTHER PUBLICATIONS

Forum Energy Technologies, Drill Pipe Float Valves, pp. 1-21, dated Feb. 2019.

Topco, Type 207—Insert Float Valve, Technical Sheet, copyright 2014.

Weatherford, Float & Stage Equipment, 2005, pp. 1-43, Brochure 67.02, copyright 2005.

Int'l Search Report and Written Opinion in counterpart PCT Appl. PCT/US2021/054322, dated Dec. 23, 2021, 10-pgs.

Weatherford, "Sure-Seal 3™ Float Shoes," Catalog, copyright 2005, p. 10.

Weatherford, drawing sheet shows the assembly of the Models 303 and 323 float shoe, admitted prior art.

* cited by examiner

FLOAT VALVE INSERT

CROSS-REFERENCE TO RELATED APPLICATIONS

This application is a continuation of U.S. application Ser. No. 16/951,562 filed Nov. 18, 2020, which is incorporated herein by reference.

BACKGROUND OF THE DISCLOSURE

Cement float equipment is used throughout the completion industry. The float equipment includes float collars and float shoes.

For example, FIG. 8A illustrates a conventional float collar 50A according to the prior art. The collar 50A includes a tubular housing 52 accommodating a fill valve 60 therein. The fill valve 60 has a valve member that is generally mushroom shaped with a head biased upwardly against a valve seat by a spring circumjacent a stem of the valve member. A base in the seat supports the valve member and the spring.

The interior 54 of the housing 52 has an annulus filled with high density cement C therein. The cement C supports the fill valve 60, and the cement C has a passage communicating with the fill valve 60. During use, mud, conditioning fluid, and cement can flow through the passage and the fill valve 60, but fluid from the borehole is not permitted to pass uphole through the valve 60.

The float collar 50A is mounted with its box end 58 at the bottom of casing (not shown). The pin end 56 can attach to another extent of casing or tubular. Alternatively, a shoe (not shown) with box thread can thread to the pin end 56 of the collar 50A to form a float shoe.

In another example, FIG. 8B illustrates a conventional flow shoe according to the prior art. The float shoe 50B includes a tubular housing 52 accommodating a fill valve 60 therein. The interior 54 of the housing 52 has an annulus filled with high density cement C disposed therein to support the fill valve 60. The cement C has a passage in which the fill valve 60 is mounted.

A nose 55 is attached to the end of the housing 52. This nose 55 can be constructed of cement, composite material, fiberglass, aluminum, or the like having wear resistant and drillable characteristics. Typically, the nose 55 can have a conical, eccentric shape to aid in run-in of the assembly by facilitating the passage of the assembly through the borehole.

Typically, the float equipment, such as in FIGS. 8A-8B, has housings configured for use with standard grades of casing and with standard forms of threads. However, conventional cement float equipment cannot be used when an installation requires a unique casing material and/or casing threads. In these situations, special float equipment may be needed, requiring long lead times to provide the particular material and/or threading.

Rather than designing float equipment with special casing material and/or threads, operators have attempted in the past to install a drillable packer in a tubular to hold an inserted float valve therein. An example can be found in U.S. Pat. No. 6,497,291. Although such a configuration may be useful, the arrangement of an inserted float valve held by a drillable packer may present an expensive solution to the problem. Inner dimensions of casing varies for different casing weights. To meet the needs for different implementations in the field, operators require a larger amount of inventory of these insert float valves and drillable packers to meet the requirements.

The subject matter of the present disclosure is directed to overcoming, or at least reducing the effects of, one or more of the problems set forth above.

SUMMARY OF THE DISCLOSURE

A float valve disclosed herein is for use in a tubular having a throughbore for flow. The float valve comprises an expanded sleeve, a first cap, a second cap, a flow tube, and a valve. The expanded sleeve has first and second ends and is composed of a first drillable material. The expanded sleeve is expanded from a smaller diameter to a larger diameter inside the tubular. The first cap is disposed on the first end of the sleeve and has a first passage therethrough. The first cap is composed of a second drillable material. The second cap is disposed on the second end of the sleeve and has a second passage therethrough. The second cap is composed of a third drillable material. The flow tube is composed of a fourth drillable material and has a bore therethrough. The flow tube is disposed between the first and second caps and is connected to the first and second passages. The valve is disposed relative to the bore of the flow tube and is configured to control the flow in the tubing through the flow tube, the valve composed of a fifth drillable material.

An exterior of the sleeve can comprise at least one of: a seal element disposed thereon and configured to seal inside the tubing; and an anchor element disposed thereon and configured to engage inside the tubing.

The valve can be disposed in the second passage of the second cap.

The valve can comprise: a ring having a seat; and a flapper hingedly attached to the ring and being movable relative to the seat.

The ring can comprise: a seal element disposed about the ring and sealed in the second passage of the second cap; and/or a snap ring disposed about the ring and affixable in a groove of the second passage.

The first cap can comprise a first seal element disposed thereabout and sealed with the first end of the sleeve. The second cap can comprise a second seal element disposed thereabout and sealed with the second end of the sleeve.

The flow tube can comprise at least one side port communicating the bore with an annular space outside the flow tube and inside the sleeve.

The flow tube can have third and fourth ends, where the third end is threaded to the first passage of the first cap, and the fourth end is threaded to the second passage of the second cap.

The first, second, third, fourth, and fifth drillable materials can be the same as or different from one another and can be selected from the group consisting of plastic, composite, metal, metal alloy, cast iron, aluminum, and brass.

The valve can be selected from the group consisting of a flapper valve, a plunger valve, and a captured ball valve.

A float assembly disclosed herein is for use on tubing. The float assembly comprises a housing, an expanded sleeve, a second drillable material, and a valve. The housing is configured to connect to the tubing and has a throughbore. The expanded sleeve is composed of a first drillable material. The expanded sleeve is expanded from a smaller diameter to a larger diameter inside the housing. The expanded sleeve has an interior and having one or more shoulders. The second drillable material is disposed in the interior of the sleeve and engages the one or more shoulders. The valve is supported in the interior of the sleeve by the second drillable material. The valve is configured to control the flow in the tubing, the valve composed of a third drillable material.

The one or more shoulders can comprise a plurality of profiles defined on an interior wall in the interior of the expanded sleeve, and the second drillable material can comprise cement filling the interior of the expanded sleeve and supporting the valve therein.

The second drillable material can comprise: a first cap disposed on a first of the one or more shoulders of the sleeve and having a first passage therethrough; a second cap disposed on a second of the one or more shoulders of the sleeve and having a second passage therethrough; and a flow tube having a bore therethrough, the flow tube disposed between the first and second caps and connected to the first and second passages, wherein the valve is disposed relative to the bore of the flow tube and is configured to control the flow in the tubing.

A method of installing a float valve into a tubular to deploy in a well having flow comprises: expanding a sleeve inside the tubular; fitting a first cap on a first end of the sleeve; connecting a flow tube to a first passage of the first cap; fitting a second cap on a second end of the sleeve; connecting the flow tube to a second passage of the second cap; and configuring a valve relative to a bore of the flow tube.

Expanding the sleeve inside the tubing can comprise: engaging a seal element disposed on an exterior of the sleeve against the tubing; and/or engaging an anchor element disposed on an exterior of the sleeve against the tubing.

Fitting the second cap can comprise: fitting the second cap with or without the valve disposed in the second passage of the second cap.

Configuring the valve relative to the bore of the flow tube can comprise: inserting the valve in the second passage of the second cap.

Inserting the valve in the second passage of the second cap can comprise: affixing a snap ring disposed about the valve in a groove of the second passage; and sealing a seal element disposed about the valve in the second passage of the second cap.

Expanding the sleeve inside the tubular, fitting the first cap on the first end of the sleeve, and connecting the flow tube to the first passage of the first cap can comprise: connecting the flow tube to the first passage of the first cap; placing the first end of the sleeve against an expansion cone on a first portion of a setting tool; holding the flow tube with a temporary attachment of the first portion of the setting tool; placing a second portion of the setting tool against the second end of the sleeve; and moving the first and second portions of the setting tool relative to one another to expand the sleeve and to fit the first cap.

A kit for installing a float valve in a tubular is disclosed herein and can comprises the expanded sleeve, the first cap, the second cap, the flow tube, and the valve disclosed herein. The kit can further comprise: a setting tool having a first portion configured to move relative to a second portion, the first portion having an expansion cone, the first portion configured to connect with a temporary attachment to the fourth end of the flow tube, the second portion configured to place against the second end of the sleeve.

The foregoing summary is not intended to summarize each potential embodiment or every aspect of the present disclosure.

DETAILED DESCRIPTION OF THE DISCLOSURE

Figure 1:
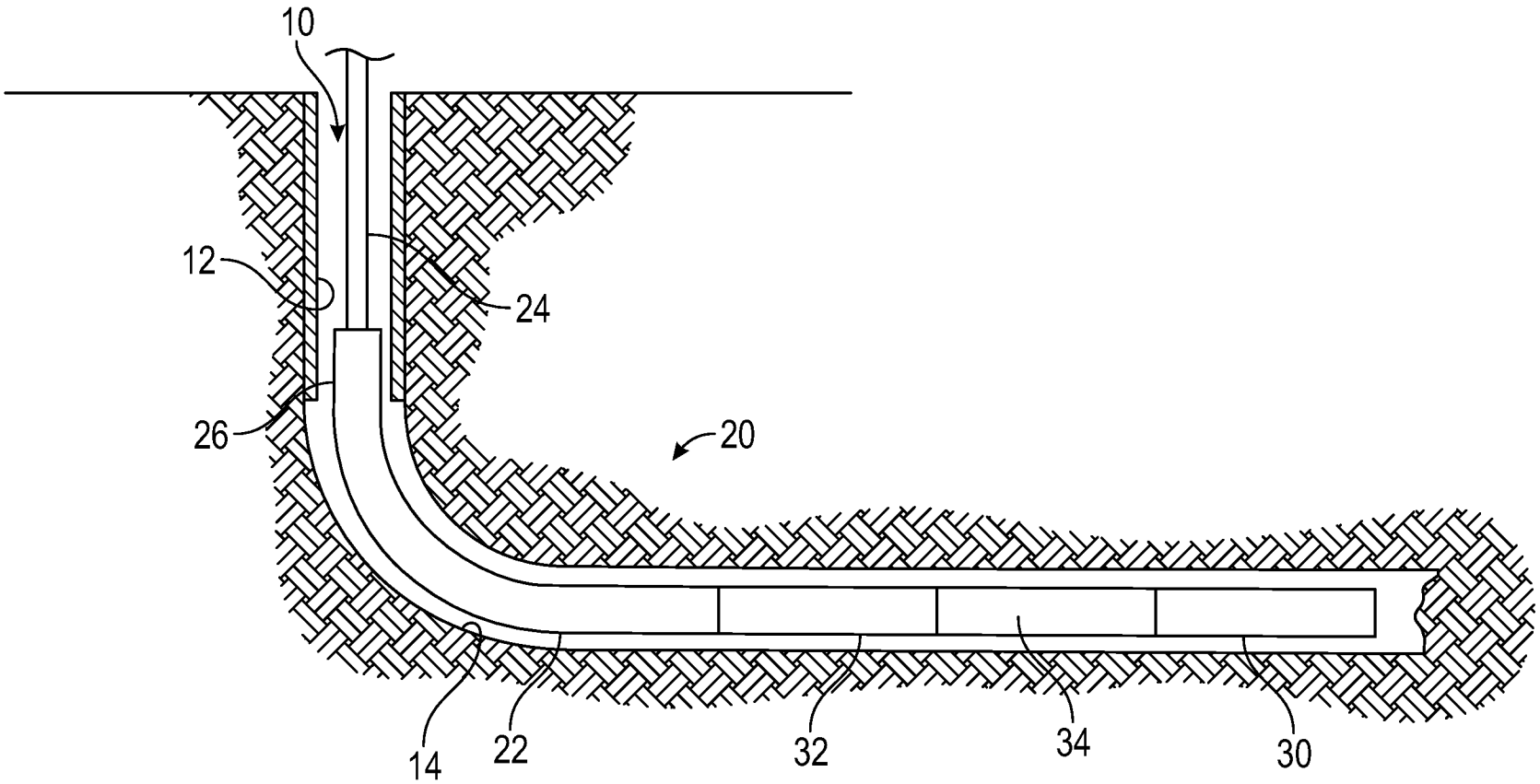
FIG. 1 illustrates a liner system having a liner disposed in a borehole and having a float valve assembly.

FIG. 1 illustrates a liner system 20 lowered into a horizontal well 10 on a work string 24. The well 10 may have a cased portion 12 and an open hole portion 14. A liner hanger 26 is supported by the work string 24 and is operable to secure the liner 22 in the well 10. The work string 24 and the liner hanger 26 may include and/or be operable with any conventional running tools known in the art for securing liner hangers in wells.

The liner 22 has one or more float valve assemblies 30, 32. For example, one float valve assembly 30 can be part of a float shoe on the liner system 20. As part of a float shoe, the assembly 30 can be used to contain backpressure and to prevent fluids from entering the liner 22 while the liner 22 is lowered into the well 10. During cementation, the assembly 30 can also prevent cement from flowing back into the liner 22 after placement.

Another float valve assembly 32 can be part of a float collar on the liner system 20. As part of a float collar, the assembly 32 is similar to a float shoe and may be placed one or more joints above a guide shoe or a float shoe. This other assembly 32 can provide a seat for cement plugs during a cement operation. The space 34 between the assemblies (i.e., float shoe 30 and the float collar 32) can be used to entrap contaminated fluids left from the wiping action of a top cementing plug during the cement operation. This space 34 can keep the contaminated fluid away from the float shoe 30 where a strong cement bond is needed.

In another arrangement, the downhole float valve assembly 30 may be a one-way valve or a check valve, such as a float valve or a float collar. This assembly 30 may permit fluid flow out of the liner system 20 and into the well 10, while preventing fluid flow into the liner system 20 from the well 10. Meanwhile, the other float valve assembly 32 can be used to form a chamber 34, which can be filled with a material having a density less than the density of the fluids in the well 10. The uphole float valve assembly 32, if present, may initially prevent fluid flow into the chamber 34 when the liner system 20 is lowered into the well 10.

The chamber 34 of lower density makes the liner 22 buoyant as the liner 22 is moved through the fluids in the well 10, which can reduce drag forces created by contact with the surfaces of the well 10. The chamber 34 may hold a vacuum or may be filled with any acceptable material, such as gas, liquid, solid, or combinations thereof (e.g., air, nitrogen, light weight liquids or solids, foam, polystyrene, plastic, rubber, or combinations thereof).

Figure 2:
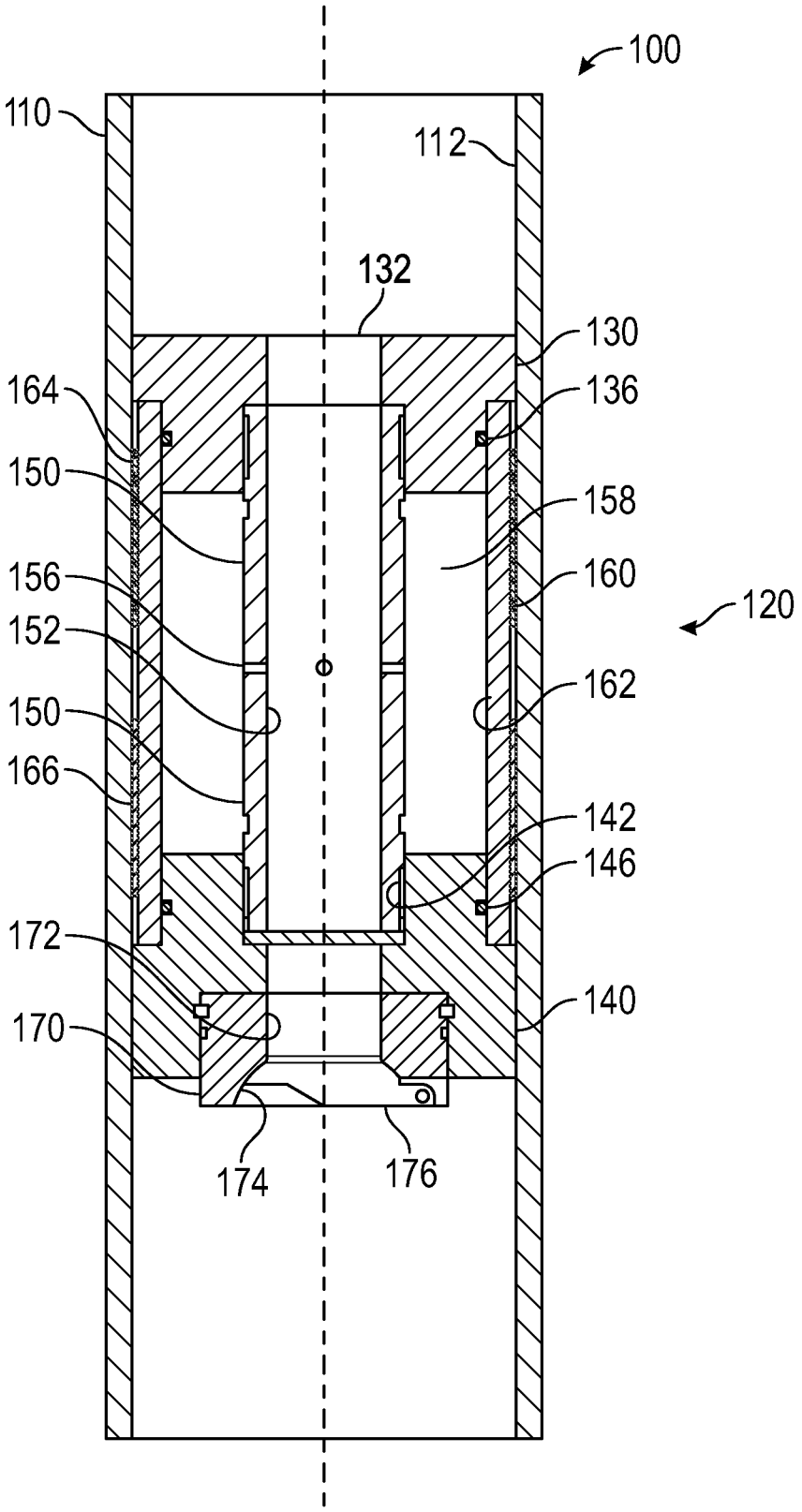
FIG. 2 illustrates a cross-sectional view of a float valve assembly having a float valve insert of the present disclosure.

FIG. 2 illustrates a float valve assembly 100 having a float valve insert 120 of the present disclosure disposed therein. This assembly 100 can be used for any of the various float valve assemblies used on a completion string, such as the float valve assemblies (30, 32) of a liner system (20) as shown in FIG. 1. In general, the assembly 100 can be used as a float valve or a float collar with various forms of completions.

The float valve assembly 100 includes a float valve insert 120 that mounts inside a throughbore 112 of a tubular 110. In general, the tubular 110 can be a casing joint, a casing pup joint, a housing or a shell of a float collar/shoe, or other tubular element. The float valve insert 120 is assembled in the tubular 110 at surface before the tubular 110 is run downhole as part of a completion string. Because the float valve insert 120 is installed in the tubular 110, the separate tubular 110 can be constructed of special grades of casing material and/or with customized casing threads (not shown) on its ends.

As discussed in more detail below, the float valve insert 120 is installed in the tubular 12 using a setting tool 70 (FIGS. 5A-5D). This installation can be done beforehand at a fabrication shop or can be done at the wellsite before installing in a well. The tubular 110 with installed float valve insert 120 is then integrated with other components of a completion string and is deployed as part of the tubing downhole on the completion string.

The float valve insert 120 includes a first cap 130, a second cap 140, a flow tube 150, a sleeve 160, and a valve 170. The first cap 130, the second cap 140, the flow tube 150, the sleeve 160, and the valve 170 are all composed of drillable materials, either the same or different from one another.

For example, the sleeve 160 is composed of an expandable, drillable metal material. When installed in the tubular 110, the sleeve 160 is expanded from a smaller diameter to a larger diameter inside the throughbore 112 of the tubular 110. The sleeve 160 can be made of any expandable metal material, including material that may dissolve over a period of time with exposed to well fluids.

The sleeve 160 can engage the throughbore 112 directly with the expanded force of the material holding the sleeve 160 in place and producing a seal. Accordingly, the sleeve 160 can be placed tightly enough in the throughbore 112 where it seals and anchors itself without any external seals or retaining anchors. For example, setting of the sleeve 160 can slightly expand the parent tubular 110, generally less than 2%.

If desired, an exterior of the sleeve 160 can include one or more seal elements 164 disposed thereon that are configured to seal inside the tubular 110. These seal elements 164 can be composed of elastomer, composite, lead, or the like. Additionally or alternatively, the exterior of the sleeve 160 can include one or more anchor elements 166 disposed thereon and configured to engage inside the tubular 110. For example, carbide coating on the exterior of the sleeve 160 can be used to engage inside the tubular 110 when the sleeve 160 is expanded.

The sleeve 160 expanded inside the tubular 110 grips inside the tubular's throughbore 112 and keeps the float valve insert 120 from moving uphole/downhole inside the tubular 110 when differential pressure is applied below the valve insert 120 or when the valve insert 120 is bumped from above. The arrangement can be compatible with various grades and materials used in casing, tubing, and the like. The expanded sleeve 160 along with all of the other components of the insert 120 can be milled out of the tubular 110 when the proper size bit is used for drillout of the float valve insert 120 after use. In this way, nothing may remain of the float valve insert 120 after drillout.

The first cap 130 is disposed on a first end of the sleeve 160 and has a first passage 132 therethrough. The first cap 130 can attach with an interference fit or with some other feature to the first end of the sleeve 160. If desired, an annular seal 136 can be provided on an outside surface of the cap 130 to seal with the sleeve 160. Alternatively or additionally, a face seal (not shown) can be used to seal the end cap 130 to the end of the sleeve 160.

The second cap 140 is disposed on a second end of the sleeve 160 and has a second passage 142 therethrough. The second cap 140 can also attach with an interference fit or some other feature to the second end of the sleeve 160. If desired, an annular seal 146 can be provided on an outside surface of the cap 130 to seal with the sleeve 160. Alternatively or additionally, a face seal (not shown) can be used to seal the end cap 140 to the end of the sleeve 160.

The flow tube 150 is disposed between the first and second caps 130, 140 and is connected to the first and second passage 132, 142. Flow in the throughbore 112 of the tubular 110 can pass through a bore 152 of the flow tube 150. The flow tube 150 can include at least one side port 156 communicating the bore 152 with an annular space 158 outside the flow tube 150 and inside the sleeve 160. This may help with equalizing pressure and preventing the flow tube 150 from collapsing or bursting.

The valve 170 is configured to control the flow in the tubular 110 through the flow tube 152. In the present example, the valve 170 is disposed in the second passage 142 of the second cap 140 to control flow relative to the flow tube 150. As discussed later, other arrangements are possible.

The valve 170 can include a check valve as commonly used in float valves/collars and can include a plunger valve, a flapper valve, a captured ball valve, etc. As shown here, the valve 170 includes a flapper valve having a ring 171 with a seat 174 formed in its internal passage 172. The ring 171 is disposed in the second passage 142 of the second cap 140, and a flapper 176 is hingedly attached to the ring 171 and is movable relative to the seat 174. A seal element 173 can be disposed about the ring 171 to seal the ring 171 in the second passage 142 of the second cap 140. The valve ring 171 can also have a snap ring 178 disposed thereabout that is affixable in a groove of the second passage 142 to hold the valve 170 in the second passage 142.

Figure 3:
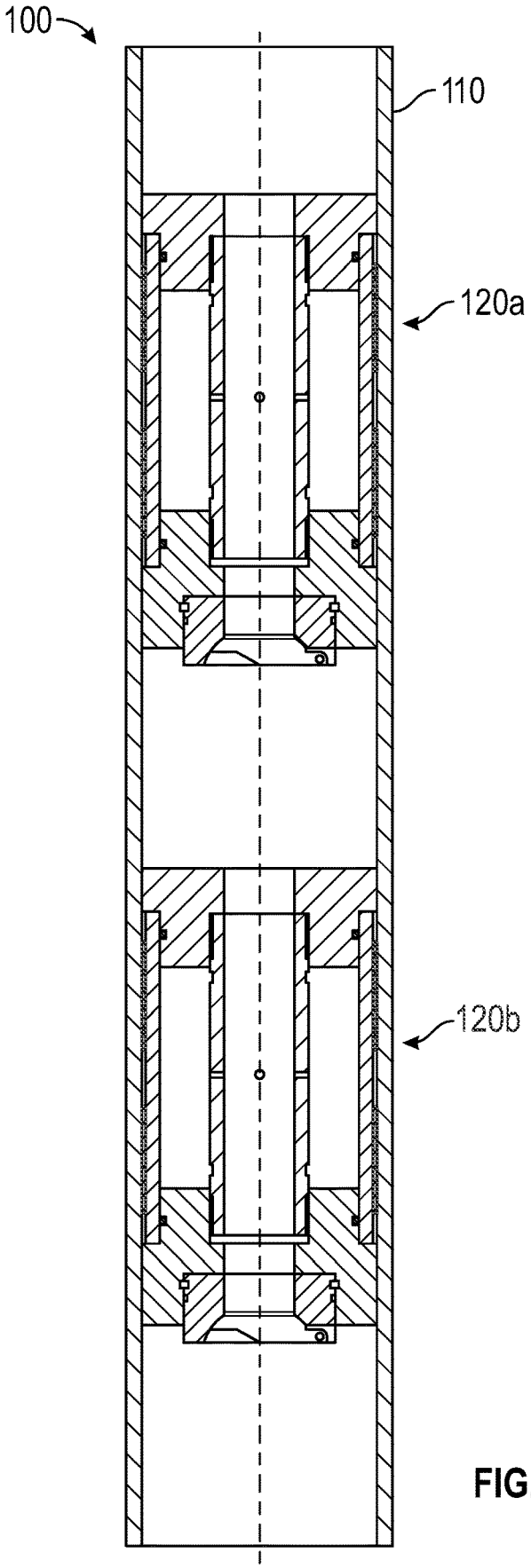
FIG. 3 illustrates a cross-sectional view of the float valve assembly having multiple float valve inserts.

FIG. 3 illustrates the float valve assembly 100 having multiple float valve inserts 120*a-b*. As will be appreciated, multiple valve arrangements can be used for a float valve/collar to provide redundancy. Here, two inserts 120*a-b* are installed in the tubular 110. These and other configurations can be used.

Figure 4A:
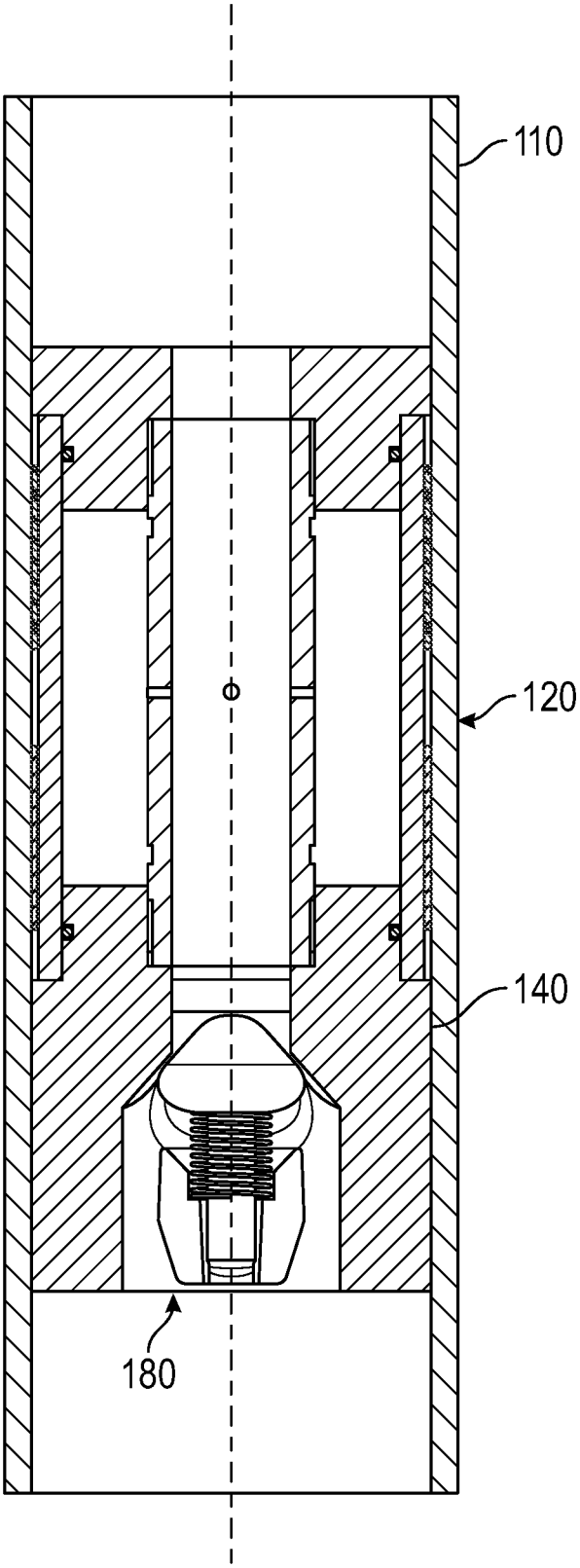
FIG. 4A-4C illustrate cross-sectional views of the flow valve assembly having float valve inserts with alternative types of valves.
Figure 4B:
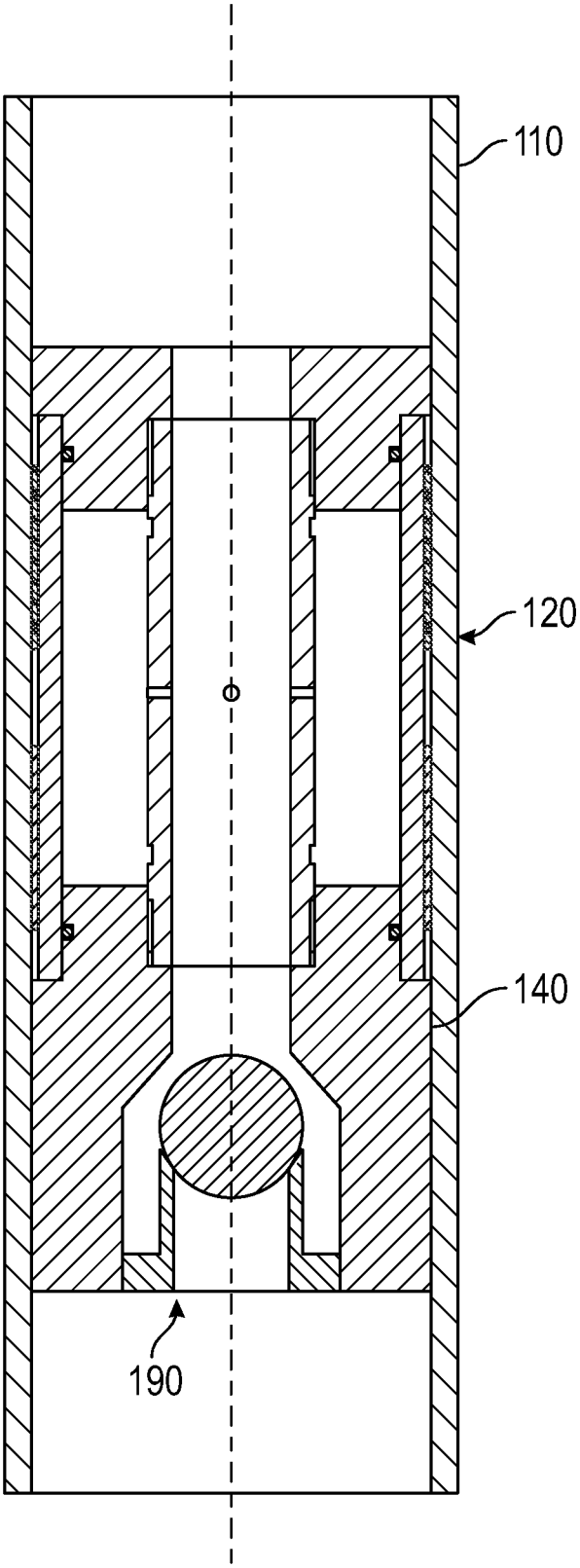

In previous examples, the valve 170 for the float valve insert 120 includes a flapper valve. Other types of valves for float equipment can be used. For example, FIGS. 4A-4B illustrate the flow valve assembly 100 having float valve inserts 120 with alternative valves. In FIG. 4A, the float valve insert 120 includes a plunger valve 180 having a plunger biased by a spring against a seat. In FIG. 4B, the float valve insert 120 includes a captured ball valve 190.

Other types of valves can be used. As also shown, the valve (e.g., 180, 190) can be already integrated into the bottom cap 140 (FIGS. 4A-4B) or can be a separate component installed onto the bottom cap 140 during the assembly steps (FIG. 2).

Figure 4C:
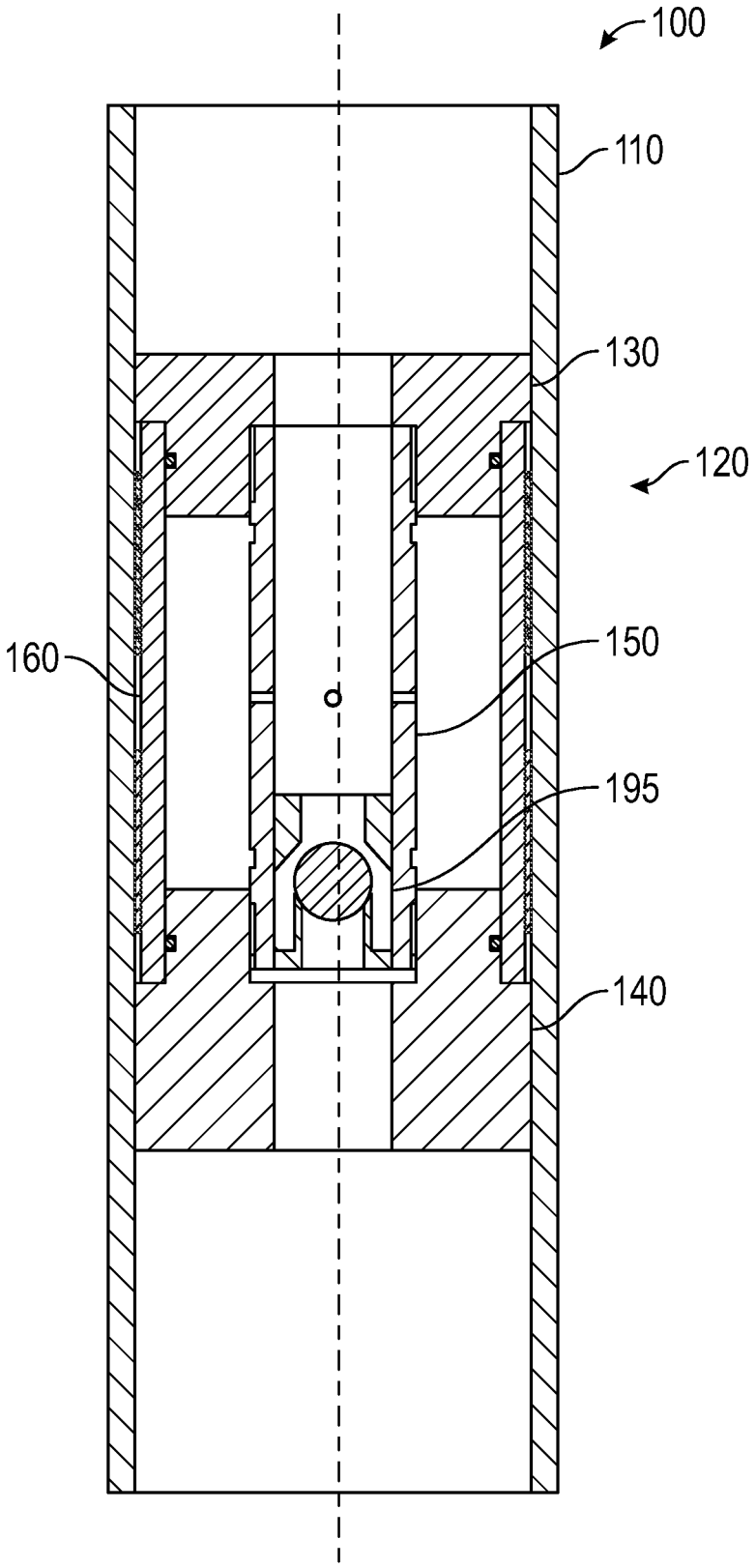

As noted above, various valves (e.g., 170, 180, 190) can be used, and the valves (e.g., 170, 180, 190) can be integrated into the cap 140 so that it does not require independent assembly. Alternatively or additionally, other components of the float valve insert 120 can include the valve (e.g., 170, 180, 190). For example, the upper cap 130 can have a valve (e.g., 170, 180, 190) installed or integrated therein. Likewise, the flow tube 150 can include a valve (e.g., 170, 180, 190) therein. As an example, FIG. 4C shows a valve 195 installed in the flow tube 150 and configured to control the flow of fluid through the bore 152.

Figure 5A:
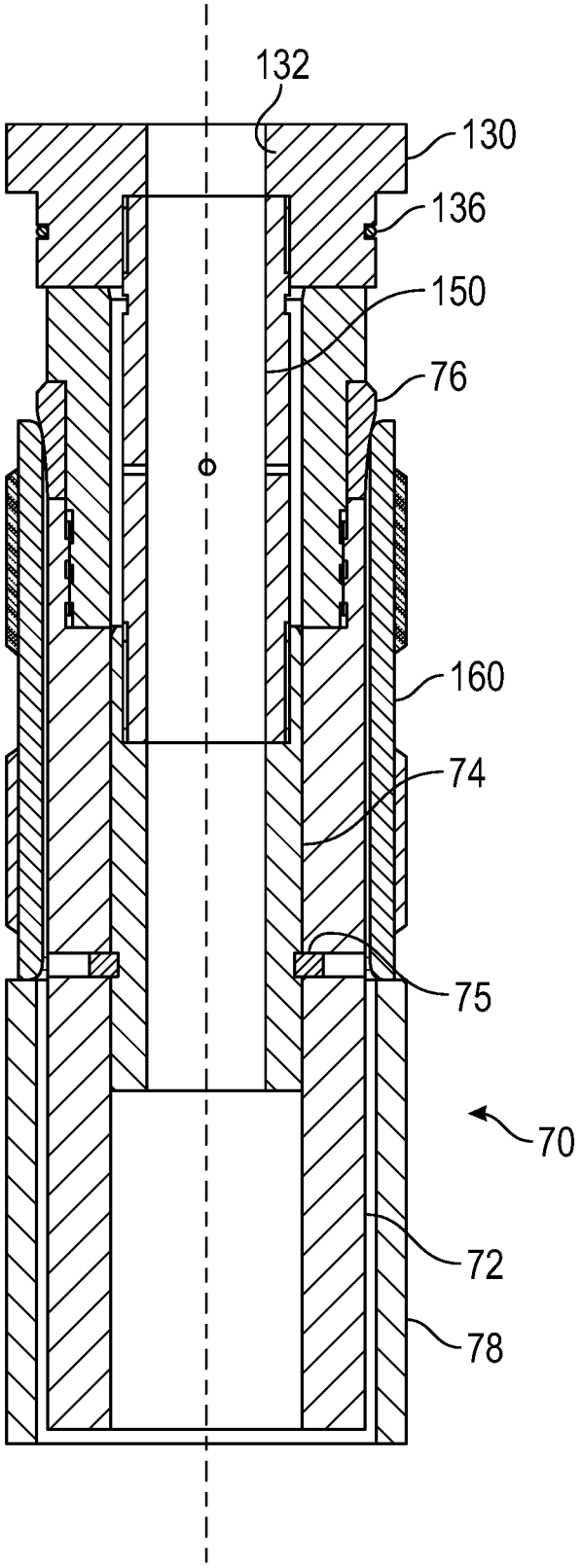
FIGS. 5A though 5F illustrate successive stages of installing the float valve insert into a tubular to produce the float valve assembly of the present disclosure.

Having an understanding of the flow valve assembly 100 of the present disclosure, FIGS. 5A though 5F illustrate successive stages of installing a float valve insert 120 into a tubular 110 to produce a float valve assembly 100 of the present disclosure.

FIG. 5A illustrates the float valve insert 120 in a cross-sectional view during a first stage of assembly. Components of the float valve insert 120 including the top cap 130, the flow tube 150, and the sleeve 160 are installed on a setting tool 70. The setting tool 70 includes an inner portion or mandrel 72 and an outer portion or mandrel 78. The inner mandrel 72 has a connector 74 connected to a bottom end of the flow tube 150, such as by threaded engagement. A temporary connection, such as shear pins 75, connect the connector 74 to the inner mandrel 72. An expansion cone 76 on the distal end of the inner mandrel 72 sets against the upper end of the sleeve 160. The upper cap 130 is attached to the upper end of the flow tube 150, such as by threaded engagement. Meanwhile, the outer mandrel 78 sets against the bottom end of the sleeve 160.

Figure 5B:
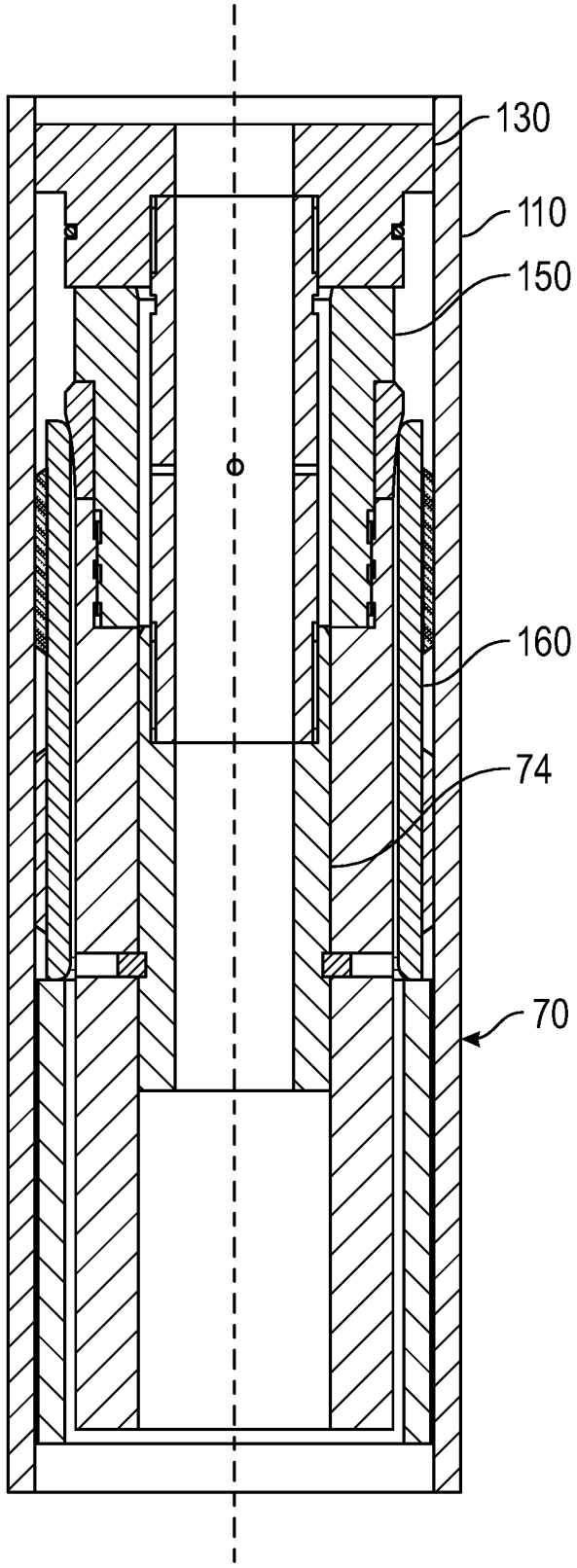
Figure 5C:
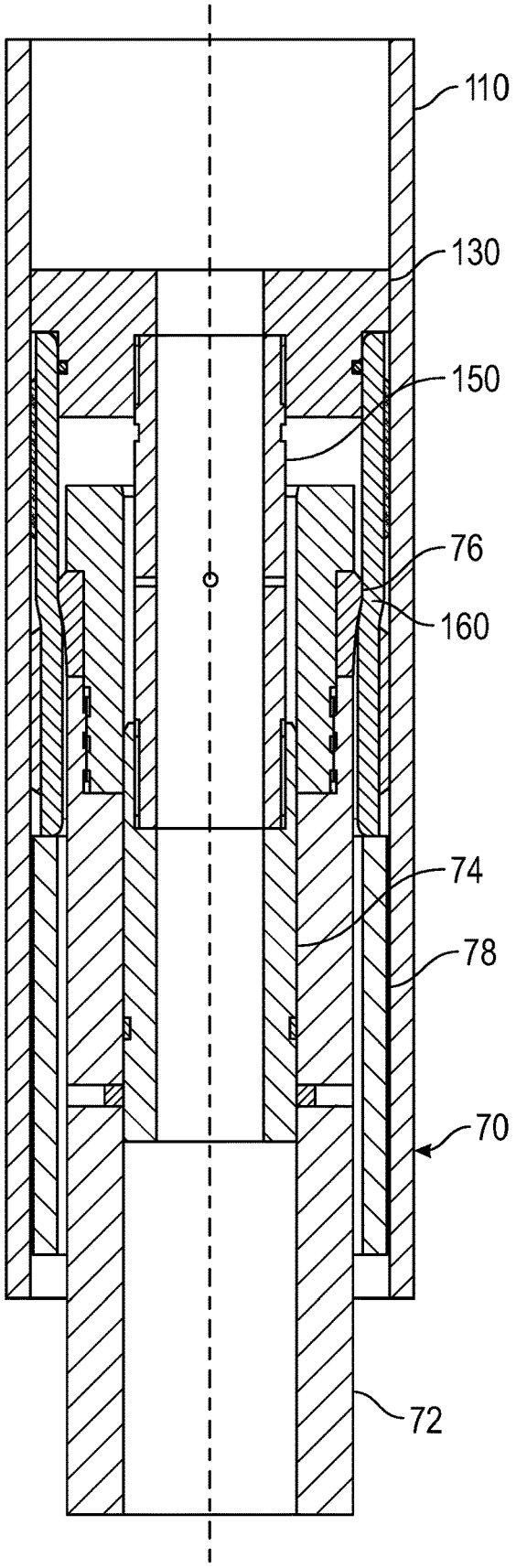

As shown in FIG. 5B, the configuration of the top cap 130, the flow tube 150, the sleeve 160, and the setting tool 70 inserts into the throughbore 112 of a tubular 110. As then shown in FIG. 5C, the inner and outer mandrels 72 and 78 of the setting tool 70 are moved relative to one another so that the expansion cone 76 passes along the inside of the sleeve 160 to expand the sleeve 160 outward against the inside of the tubular 110. At some point in this movement, the upper cap 130 fits against the top of the sleeve 160, and the connector 74 shears free of the inner mandrel 72. Continued movement of the expansion cone 76 expands the rest of the sleeve 160 against the inside of the tubular 110.

Figure 5D:
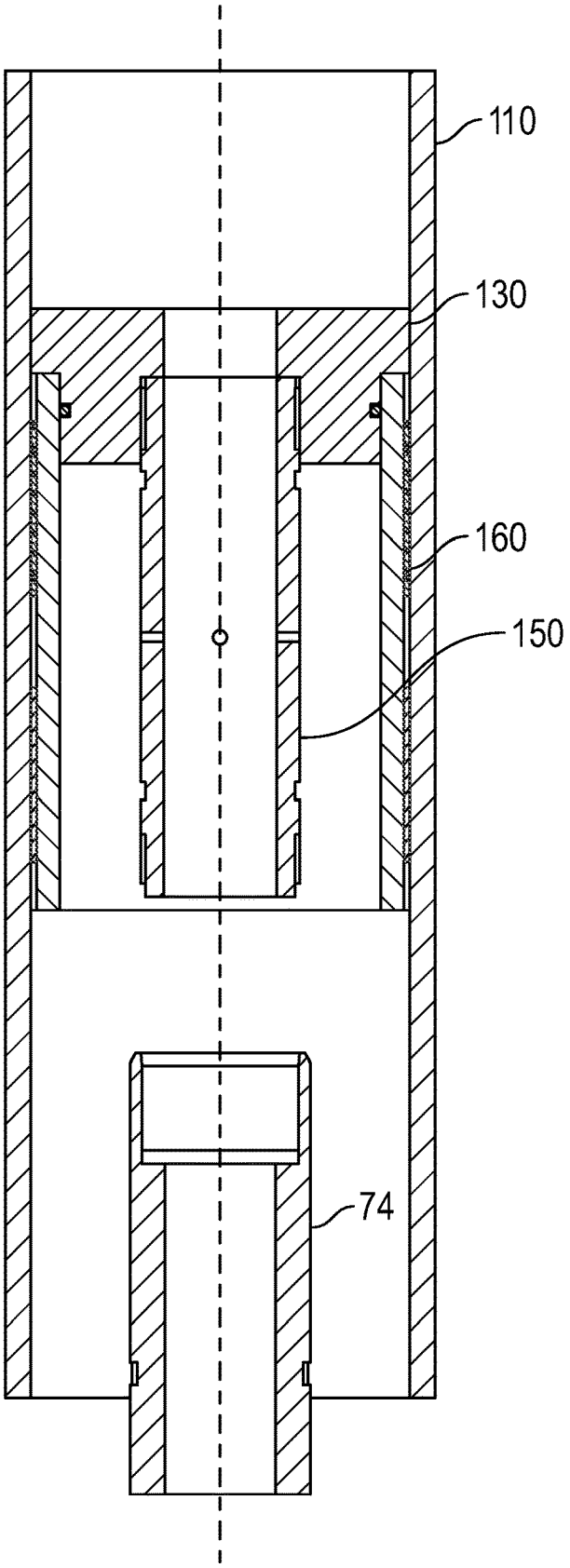
Figure 5E:
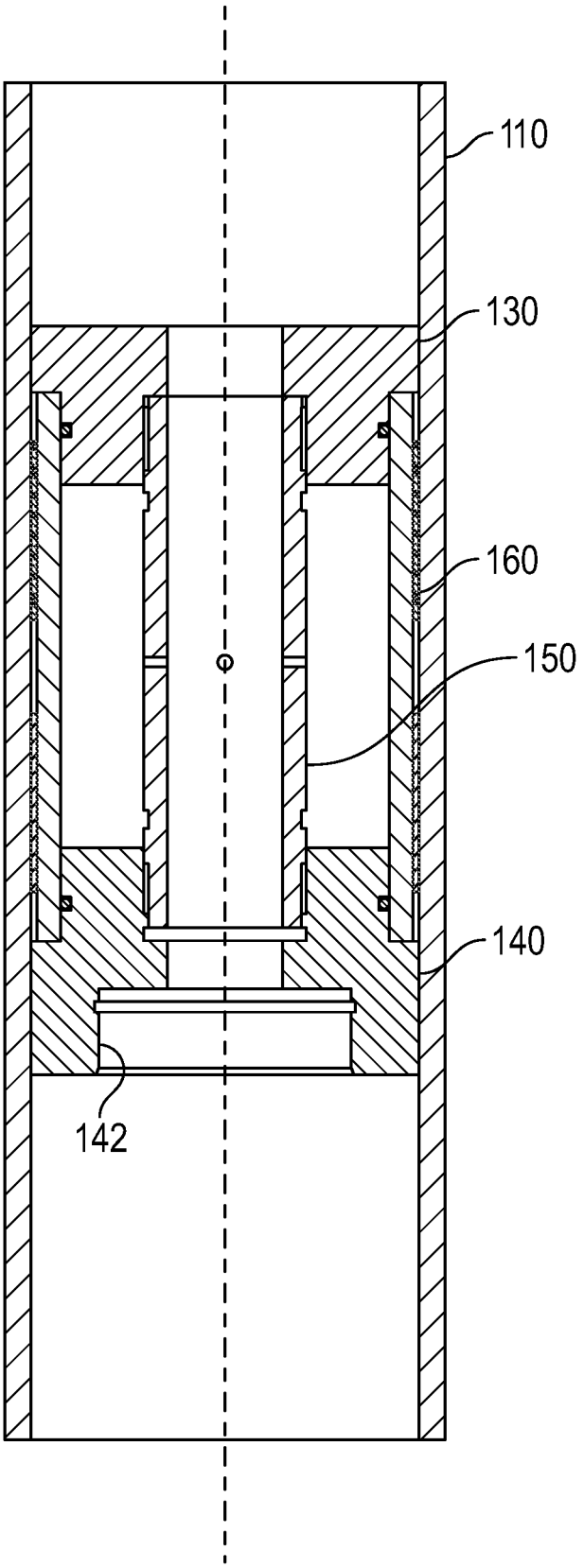

As shown in FIG. 5D with the setting tool 70 removed from the tubular 110, the connector 74 is detached from the end of the flow tube 150. Then as shown in FIG. 5E, the bottom cap 140 fits onto the bottom end of the sleeve 160 and is connected to the lower end of the flow tube 150. For example, an interference fit may be used between the bottom cap 140 and the sleeve 160, and a threaded connection or snap-lock arrangement can affix the passage 142 on the cap 140 onto the lower end of the flow tube 150.

Figure 5F:
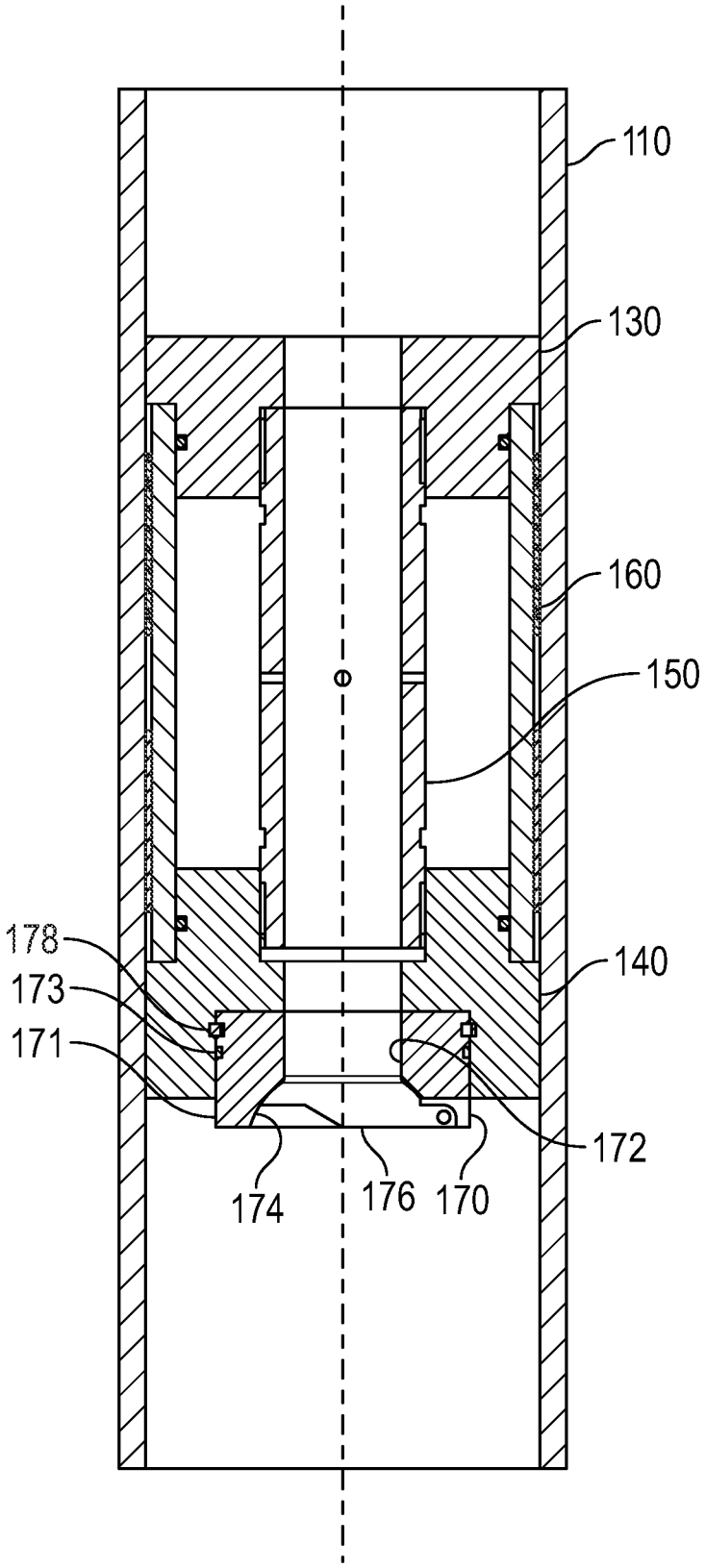

As then shown in FIG. 5F, the valve 170 can be installed onto the bottom cap 140 if not already affixed in place or incorporated therein. As shown here and as discussed before, the valve 170 can be a flapper valve having a ring 171 with a seat 174 defined in its internal passage 172. A flapper 176 is biased by a torsion spring at a hinge to close against the seat 174. A snap ring 178 on the ring 174 can engage in a groove of the cap's passage 142, and a seal 173 can seal between the passage 142 and the ring 171.

Figure 6:
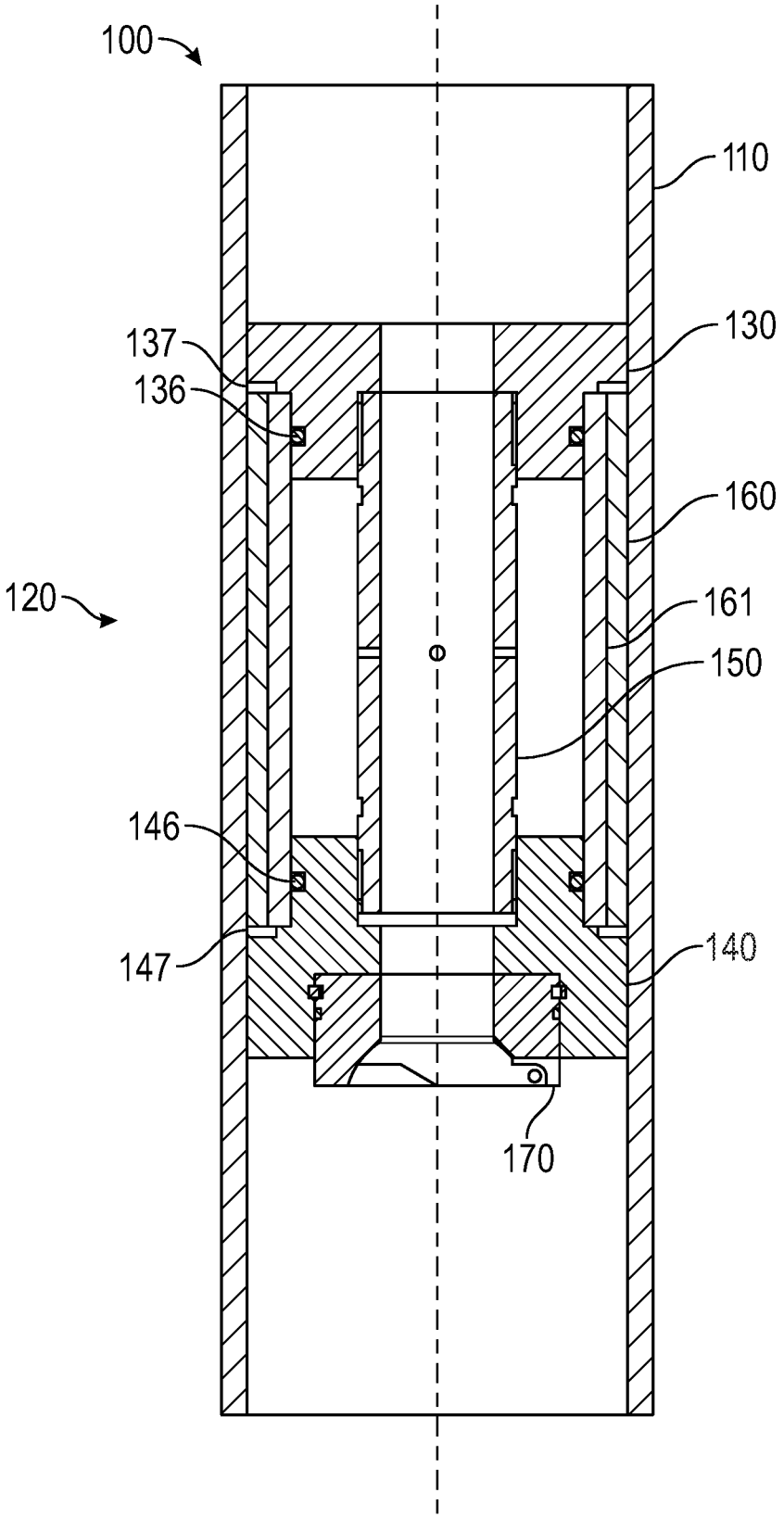
FIG. 6 illustrates a cross-sectional view of a float valve assembly having another float valve insert of the present disclosure.

FIG. 6 illustrates a cross-sectional view of a float valve assembly 100 having another float valve insert 120 of the present disclosure disposed therein. As before, the float valve insert 120 mounts inside a throughbore 112 of a tubular 110. In general, the tubular 110 can be a casing joint, a casing pup joint, a housing or a shell of a float collar/shoe, or other tubular element. The float valve insert 120 is assembled in the tubular 110 at surface before the tubular 110 is run downhole as part of a completion string. Because the float valve insert 120 is installed in the tubular 110, the separate tubular 110 can be constructed of special grades of casing material and/or with customized casing threads (not shown) on its ends.

In the present example, the float valve insert 120 includes outer and inner sleeves 160, 161. The outer sleeve 160 can be composed of metal and can be expanded inside the tubular 110 using an expansion tool. The inner sleeve 161, which can also be composed of metal, can then be expanded inside the tubular 110 while constructing the insert 120 with the setting tool (70) in the steps disclosed previously. This can provide a more robust engagement of the insert 120 with the sidewall of the tubular 110. The two sleeves 160, 161 can be of thinner material, facilitating expansion.

As further shown in FIG. 6, face seals 137, 147 can be used to seal the end caps 130, 140 to the ends of the sleeve 160.

The use of the two expanded sleeves 160, 161 can offer a number of advantages. The two sleeves 160, 161 can be of the same or different materials. As one example, the outer sleeve 160 can be composed of a special material (e.g., tritium), while the inner sleeve 161 can be made of a carbon steel.

Figure 7:
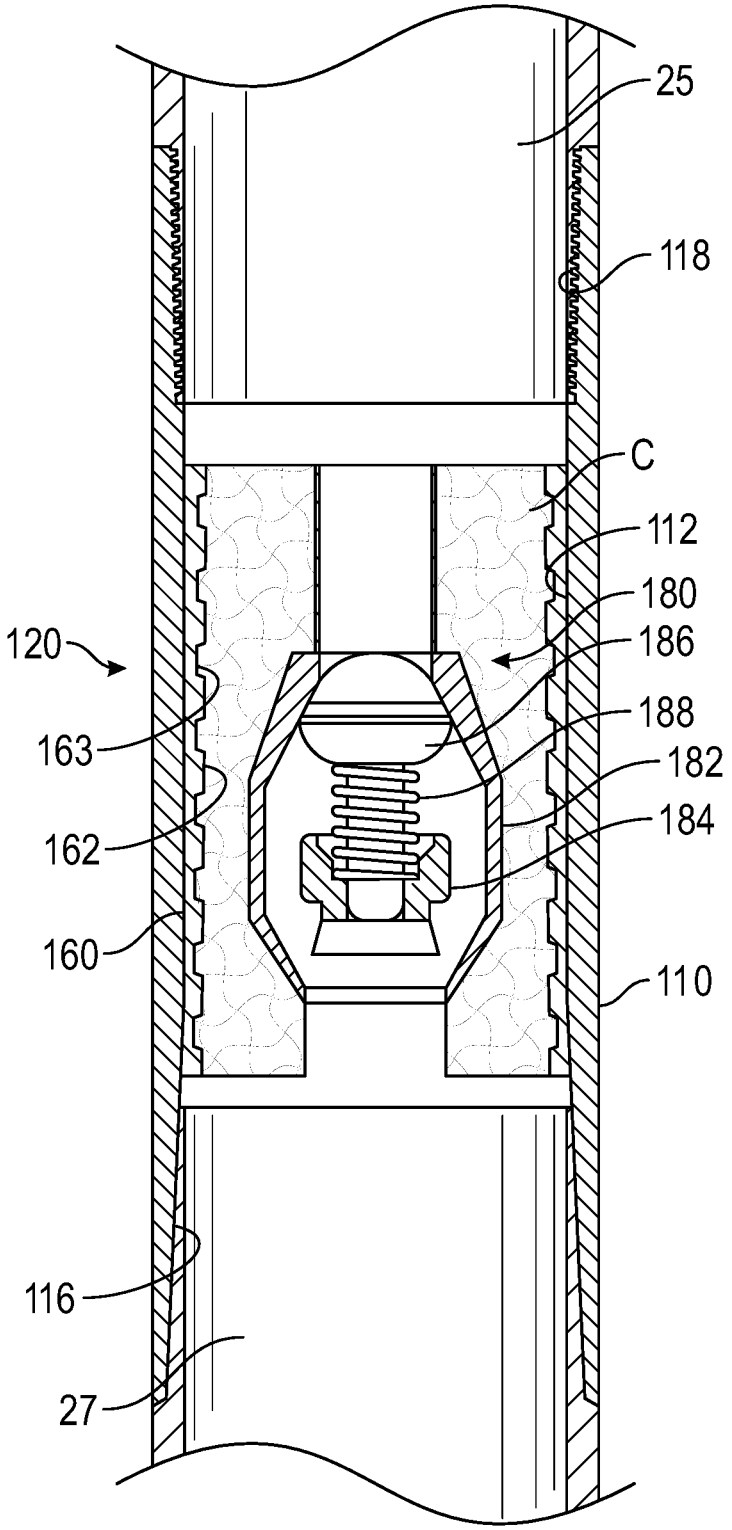
FIG. 7 illustrates a cross-sectional view of another float valve assembly having a float valve insert of the present disclosure.
Figure 8A:
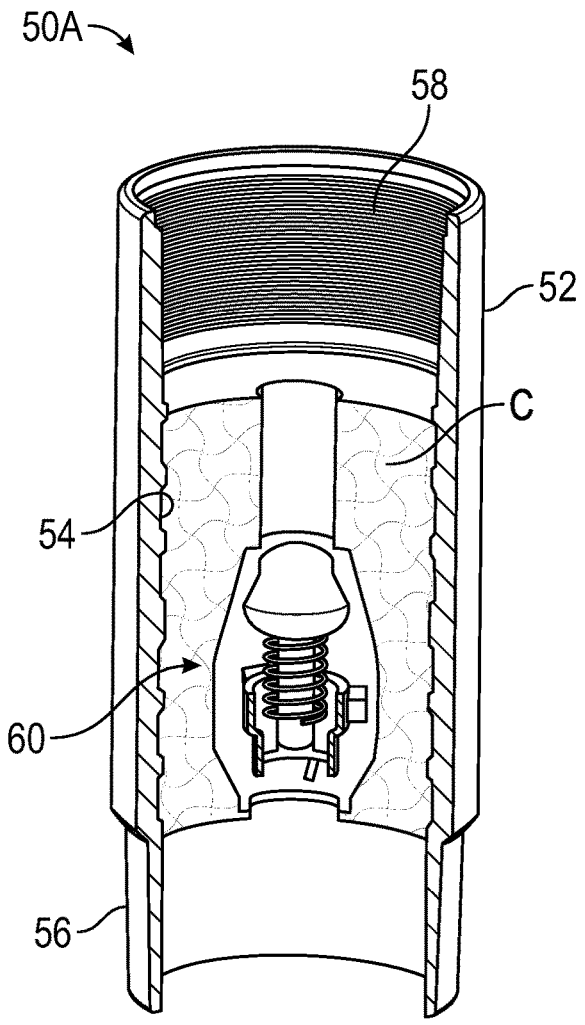
FIG. 8A (Prior Art)
FIG. 8A illustrates a float collar according to the prior art.
Figure 8B:
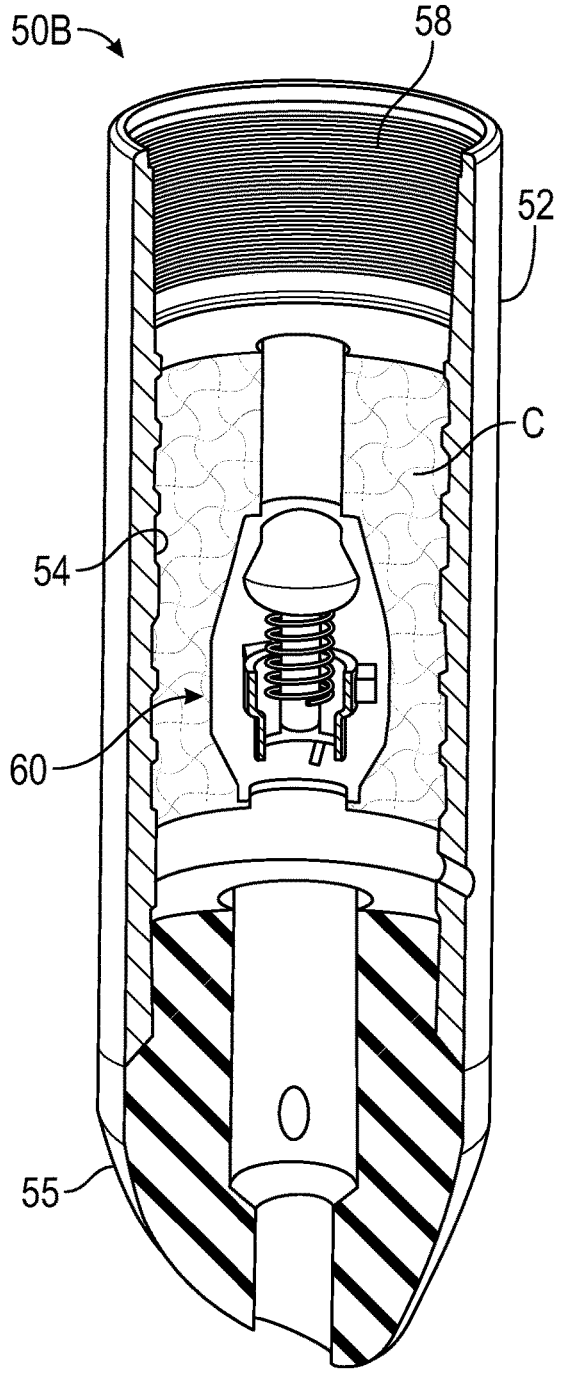
FIG. 8B (Prior Art)
FIG. 8B illustrates a flow shoe according to the prior art.

FIG. 7 illustrates a cross-sectional view of another float valve assembly 100 having a float valve insert 120 of the present disclosure. The assembly 100 includes a tubular housing 110 accommodating a fill valve 180 therein. The fill valve 180 has a valve member 186 that is generally mushroom shaped with a head biased upwardly against a valve seat 182 by a spring 188 circumjacent a stem of the valve member 186. A base 184 in the seat 182 supports the valve member 186 and the spring 188.

The interior 112 of the housing 110 has a sleeve 160 of the present disclosure expanded therein. The sleeve 160 has an annulus filled with high density cement C disposed therein. The cement C supports the fill valve 180 and has a passage communicating with the fill valve 180. During use, mud, conditioning fluid, and cement can flow through the passage and the fill valve 180, but fluid from the borehole is not permitted to pass uphole through the valve 180.

The float assembly 100 is mounted with its box end 118 at the bottom of casing 25. The other end 116 can be a pin end or a box end for attaching to another extent of casing 27, tubular, shoe, etc. Although not shown in FIG. 7, this float valve insert 120 can include any of the other components of the inserts disclosed herein, such as end caps and the like.

As shown, the inside surface 162 of the expanded sleeve 160 can be machined after being expanded in the housing 110 to have profiles 163. In particular, during assembly, the sleeve 160 can be expanded inside the interior 112 and can then be machined to produce these profiles 163. When the cement C is placed to hold the fill valve 180, these profiles 163 provide inner shoulders and support for the cement C. In this way, the assembly process does not require machining of the tubular 110, which may be made of a particular material difficult or expensive to machine, may require a particular sidewall thickness for the implementation, etc. Instead, machining of the expanded sleeve 160 can be performed, which may simplify fabrication and meet particular requirements of an implementation.

According to the present disclosure, the float valve assembly 100 as constructed with the insert 120 in the tubular 110 can then be integrated into other equipment for a completion string to be run downhole in a borehole. For example, the tubular 110 as a casing joint, pup joint, housing, etc. can have pin and/or box thread connections for installing the tubular 110 as part of a tubing string to be run downhole.

The caps 130, 140 can be composed of plastic, composite, drillable metal, etc. The caps 130, 140 can also have a non-rotating profile. The sleeve 160 can be composed of a drillable plastic, composite, metal, metal alloy, cast iron, aluminum, brass, etc. Rubber sealing element 164 and anchor elements 166 can be bonded to the exterior of the sleeve 160. The anchor elements 166 can include anchor chips, such as carbide, teeth, etc. Threads are shown connecting the ends of the flow tube 150 to the passages 132, 142 of the caps 130, 140, but other connections can be used, such as snap rings, latch-ratchets, etc.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of incorporating a float valve assembly with a tubular, the tubular to be deployed on tubing in a well having flow, the method comprising:

expanding a sleeve composed of a first drillable material from a smaller diameter to a larger diameter inside the tubular;

positioning a valve in an interior of the sleeve expanded inside the tubular, the valve configured to control the flow in the tubing, the valve composed of a second drillable material; and supporting the valve in the interior of the sleeve by filling an annulus between the valve and the interior of the sleeve with a third drillable material and engaging the third drillable material on one or more shoulders disposed on the sleeve.

2. The method of claim 1, wherein expanding the sleeve inside the tubular comprises:

engaging an exterior of the sleeve directly against the tubular;

engaging a seal element disposed on the exterior of the sleeve against the tubular; and/or engaging an anchor element disposed on the exterior of the sleeve against the tubular.

3. The method of claim 1, wherein expanding the sleeve inside the tubular comprises:

positioning the sleeve inside the tubular;

placing a first end of the sleeve against an expansion cone on a first portion of a setting tool;

placing a second portion of the setting tool against a second end of the sleeve; and moving the first and second portions of the setting tool relative to one another to expand the sleeve.

4. The method of claim 3, wherein expanding the sleeve comprises expanding the sleeve while the sleeve has a smooth interior wall on the interior; and wherein the method comprises machining the one or more shoulders on the smooth interior wall after the sleeve is expanded.

5. The method of claim 4, wherein machining the one or more shoulders on the smooth interior wall after the sleeve is expanded comprises reducing a wall thickness of the first drillable material at one or more locations inside the interior of the sleeve expanded in the tubular without machining the tubular.

6. The method of claim 1, comprising producing flow passages in the third drillable material, the flow passage communicating opposing ends of the valve outside the third drillable material.

7. The method of claim 1, wherein expanding the sleeve inside the tubular comprises expanding the sleeve inside a housing for the tubular configured to connect to the tubing.

8. The method of claim 7, wherein the housing is a tubing joint having pin and/or box thread connections configured to connect the tubing joint as part of the tubing to be run downhole.

9. The method of claim 1, wherein the one or more shoulders include edges disposed on ends of the sleeve.

10. The method of claim 1, wherein the one or more shoulders include a plurality of profiles defined on an interior wall in the interior of the sleeve.

11. The method of claim 1, wherein the third drillable material is a cement filling the annulus and supporting the valve.

12. The method of claim 1, wherein the first and second drillable materials are the same as or different from one another and are selected from the group consisting of plastic, composite, metal, metal alloy, cast iron, aluminum, and brass.

13. The method of claim 1, wherein the valve is selected from the group consisting of a flapper valve, a plunger valve, and a captured ball valve.

14. A float assembly for incorporation with a tubular to be deployed on tubing in a well having flow, the float assembly comprising: a sleeve being expandable from a smaller diameter to a larger diameter, the sleeve being composed of a first drillable material and having one or more shoulders; a valve composed of a second drillable material; and a third drillable material, wherein the float assembly is produced by a method comprising the steps of:

expanding the sleeve from the smaller diameter to the larger diameter inside the tubular;

positioning the valve in an interior of the sleeve expanded inside the tubular, the valve configured to control the flow in the tubing; and supporting the valve in the interior of the sleeve by filling an annulus between the valve and the interior of the sleeve with the third drillable material and engaging the third drillable material on at least one of the one or more shoulders disposed on the sleeve.

15. The float assembly of claim 14, wherein the step of expanding the sleeve inside the tubular comprises the steps of:

engaging an exterior of the sleeve directly against the tubular;

engaging a seal element disposed on the exterior of the sleeve against the tubular; and/or engaging an anchor element disposed on the exterior of the sleeve against the tubular.

16. The float assembly of claim 14, wherein the step of expanding the sleeve inside the tubular comprises the steps of:

positioning the sleeve inside the tubular;

placing a first end of the sleeve against an expansion cone on a first portion of a setting tool;

placing a second portion of the setting tool against a second end of the sleeve; and moving the first and second portions of the setting tool relative to one another to expand the sleeve.

17. The float assembly of claim 16, wherein the step of expanding the sleeve comprises the steps of:

expanding the sleeve while the sleeve has a smooth interior wall on the interior; and machining the one or more shoulders on the smooth interior wall after the sleeve is expanded by reducing a wall thickness of the first drillable material at one or more locations inside the interior of the sleeve expanded in the tubular without machining the tubular.

18. The float assembly of claim 14, wherein the method further comprises producing flow passages in the third drillable material, the flow passage communicating opposing ends of the valve outside the third drillable material.

19. The float assembly of claim 14, wherein the step of expanding the sleeve inside the tubular comprises the step of expanding the sleeve inside a housing for the tubular configured to connect to the tubing, wherein the housing is a tubing joint having pin and/or box thread connections configured to connect the tubing joint as part of the tubing to be run downhole.

20. The float assembly of claim 14, wherein least one of:

the one or more shoulders include edges disposed on ends of the sleeve;

the one or more shoulders include a plurality of profiles defined on an interior wall in the interior of the sleeve;

the third drillable material is a cement filling the annulus and supporting the valve;

the first and second drillable materials are the same as or different from one another and are selected from the group consisting of plastic, composite, metal, metal alloy, cast iron, aluminum, and brass; and the valve is selected from the group consisting of a flapper valve, a plunger valve, and a captured ball valve.

* * * * *